US008439668B2

(12) United States Patent
Ambroggio

(10) Patent No.: US 8,439,668 B2
(45) Date of Patent: May 14, 2013

(54) CANDLE CONTAINER AND CANDLE WITH EXTINGUISHING PROPERTIES

(75) Inventor: Piergiorgio Ambroggio, Turin (IT)

(73) Assignee: SER S.p.A., Santena (IT)

( * ) Notice: Subject to any disclaimer, the term of this patent is extended or adjusted under 35 U.S.C. 154(b) by 476 days.

(21) Appl. No.: 12/681,430

(22) PCT Filed: Oct. 4, 2007

(86) PCT No.: PCT/EP2007/060545

§ 371 (c)(1),
(2), (4) Date: May 11, 2010

(87) PCT Pub. No.: WO2009/043380

PCT Pub. Date: Apr. 9, 2009

(65) Prior Publication Data

US 2010/0221674 A1 Sep. 2, 2010

(51) Int. Cl.
*F23D 3/16* (2006.01)

(52) U.S. Cl.
USPC ..... 431/289; 431/291; 431/288; 169/27

(58) Field of Classification Search ..... 431/288–297; 169/27

See application file for complete search history.

(56) References Cited

U.S. PATENT DOCUMENTS 5,833,874 A * 11/1998 Stewart et al. ..... 252/8

FOREIGN PATENT DOCUMENTS

DE 20121402 * 8/2012

* cited by examiner

*Primary Examiner* — Alfred Basichas
(74) *Attorney, Agent, or Firm* — Harness, Dickey & Pierce, PLC

(57) ABSTRACT

A container for holding a combustible is provided, the container having a first portion for receiving the combustible and a second portion containing an extinguishing substance, characterized in that the extinguishing substance is in thermal contact with the first portion and is adapted to be set free if it exceeds a predefined temperature. Also provided is a candle comprising such a container, wherein the first portion contains candle wax, lamp oil or petroleum gel, and a wick.

12 Claims, 5 Drawing Sheets

CANDLE CONTAINER AND CANDLE WITH EXTINGUISHING PROPERTIES

The present invention relates to a container which is capable of automatically extinguishing a combustible, such as candle wax, contained therein in cases where the whole or a part of the combustible begins to burn uncontrollably and/or exceeds a given temperature, thereby posing a threat to people and its environment. The present invention relates in particular to a candle with extinguishing properties, i.e. a container containing the combustible such as candle wax therein.

STATE OF THE ART

Candles are a steady companion of mankind and have been used for lighting and decorative purposes for thousands of years. The combustion of candle wax by means of a wick serves to provide light, decorative effects and other purposes such as scenting a room etc. Whereas in past centuries most candles were candles made entirely out of wax, i.e. without a container, more recently candles have been provided with a suitable container to avoid liquid wax running off during combustion of the candle. In this way, the surface the candle stands upon could be kept clean and, importantly, the liquid wax that would have run off before, was confined and was not lost for combustion. Moreover, the container provided a higher degree of safety, since the candle would no longer become unstable and risk falling over if large parts of the wax softened during combustion. Thus, a first step to fire prevention was done.

More recently, such containers were also used with other combustibles such as lamp oils or scented oils, among others. Therefore it is to be understood that, whenever in the following description the term "candle" or "wax" is used, other combustibles, both liquid or solid, which can be used like a wax candle and/or can be contained within such containers, are equally included.

However, even though the combustion of a candle within a container can be described as controlled or predictable because it can be initiated and extinguished by hand in a controlled manner without the risks posed by unconfined liquid or softened wax, fire hazards nevertheless emerge from candles burning out unattended. This means that towards the end of the burning process of a candle, when the wax and/or the wick are nearly consumed, the burning flame may heat up the container to such a level or, in extreme cases, even ignite it so that the surface or the immediate surroundings of the candle catch fire, too, with obvious dangers for people and property.

To address this hazard, several different candle designs have been developed aimed at interrupting the regular combustion of the candle at a predefined moment, in general towards the end of the candle's life. An example of one design is given in DE 20 2006 002 644 U1 in which a cavity is provided towards the bottom part of the candle and the cavity is filled with an extinguishing substance such as water. Once the burning wick reaches the cavity, it contacts the water and is extinguished.

A similar design is proposed in DE 41 39 713 A1 in which there is also provided an extinguishing agent in a recess around the wick or in the side of the candle, in both cases in contact with the wick. Again, when the candle has burned down sufficiently, the burning wick touches the extinguishing agent and the flame dies.

A different solution is proposed in EP 0 279 883 B1, in which a heat-shrinkable tube is provided around the wick at a given height at which extinguishing is desired. Once the wick has burned down so that the flame reaches the top of the heat-shrinkable tube, the tube contracts around the burning wick, sealing it off and depriving it of oxygen. Thus, the candle is extinguished.

In WO 92/08776 A1, a heat-conductive sleeve tightly encloses the wick at a given height. The sleeve is anchored to the bottom of the candle and has openings for the passage of liquid wax material. Once the flame reaches the sleeve, it cannot wander further down. However, the sleeve conducts the heat of the flame and melts the wax around it, which can pass through the openings and reach the top of the sleeve where the wick can continue burning. Once the liquefied wax in vicinity of the sleeve is exhausted, the flame is extinguished.

Finally, in WO 2004/044112 A1 a flame retardant is added to the wax material in increasing concentration from top to bottom. Thus, when the candle burns down, the wax eventually no longer supports the combustion and the candle is extinguished.

It is evident that the mentioned candle designs are capable of extinguishing a candle left unattended at a given point of its combustion, i.e. when the flame reaches a predefined height of the wick. However, none of the mentioned designs is capable of extinguishing a candle in the far more dangerous situation in which the entire wax of a candle exceeds a certain temperature and starts to burn. This situation may be little known, but is in fact rather common in candles, in particular with containers, for instance when multiple candles are put very close together or when, as often happens, additional improper wicks such as matches are stuck into the wax next to the wick. Also, multiple wick candles have become common and may experience this effect. Finally, there have been cases where unlit candles have been placed in places of intense heat such as upon electric radiators or stoves.

What happens, in fact, is that in all these cases the vicinity of the wicks creates a hot air column rising upwards from the flames. While with a single candle the motion of air generally becomes quickly turbulent and does not lead to a dangerous rise in temperatures around the wick, with multiple flames a laminar air motion is created with hot air rising at the centre above the flames and cooler air sinking down in the periphery and being strongly sucked toward the bottom of the flame, thereby steadily supplying oxygen. The net effect is that a single large flame may be created, leading to intense temperatures around them. The liquefied wax around the burning wicks, which cannot escape the container, thus quickly reaches its combustion temperature, with the result that the entire wax starts to burn uncontrollably with an even larger flame. In particular, the vapours of the wax above the liquid surface reach their ignition temperature and lead to the entire wax surface catching fire.

Additionally, in cases where one or more (proper or improper) wicks are close to a metallic container wall, what may happen is that the container wall conducts the heat even to wax not yet liquefied and thus accelerates the above mentioned process. If the container wall happens to be made of organic material such as compound paper (as is sometimes the case), the container wall itself may start to burn.

It is easy to see why the above-mentioned known designs cannot avoid such a situation. Firstly, they react only at a certain height of the candle and secondly, even if they could react, their mechanisms of extinction are aimed at the burning wick only, not at the entire wax or wax surface.

SUMMARY OF THE INVENTION

It is therefore an object of the present invention to provide a container for holding a combustible that is capable of extinguishing the combustible in any given situation of fire hazard, such as when the entire or a part of the combustible begins to burn. It is another object of the present invention to provide a candle that is capable of extinguishing itself in these situations of fire hazard.

It is also an object of the invention to provide a container and a candle that exhibit superior safety mechanisms against mishandling by consumers.

These objects are achieved by a container having the features of claim 1 and a candle having the features of claim 12. Further preferred and optional features are defined in the dependent claims.

According to an aspect of the present invention, a container for holding a combustible comprises a first portion for receiving the combustible and a second portion containing an extinguishing substance. The extinguishing substance is in thermal contact with the first portion and is adapted to be set free at or above a predefined temperature. Thus, as soon as the temperature of the first portion, i.e. the combustible reaches the predefined critical temperature, the extinguishing substance is capable of extinguishing the burning combustible, or of preventing it to ignite.

The term "thermal contact" as used herein means that any temperature change in the first portion is communicated to the extinguishing substance without substantial delay, leading to a proportional increase in temperature of the latter.

Here, the term "adapted to be set free" means that all or part of the extinguishing substance leaves its space where it is confined and moves into the portion where the combustible is, and beyond. In doing so, the extinguishing substance deprives the combustible of oxygen or otherwise inhibits its combustion, thereby leading to a complete extinction of the flame. Since the extinguishing substance is only liberated when the combustible itself exceeds the predefined temperature, but not when this temperature is reached, for example, by the burning wick, the normal combustion process of the combustible (e.g. a candle) is unaffected. Only in emergency cases, i.e. if the combustible reaches the predefined temperature due to improper handling thereof, as discussed above, the extinguishing action sets in.

Further, it is to be understood that the term "combustible" or "wax" used throughout the description and the claims may be any combustible material such as paraffin, bees wax, stearin, candle gels of various types, oils etc.

The container can be made of any suitable material, such as glass, metal (e.g. aluminium), compound paper, plastics (e.g. polypropylene or polyethylene), terracotta, ceramics or even wood.

Preferably, the extinguishing substance comprises a substance that is gaseous above the predefined temperature. Being a gas, the extinguishing substance can easily and quickly penetrate the whole of the burning combustible and extinguish it.

According to a preferred embodiment, the extinguishing substance is a water-containing gel. On the one hand, as the combustible reaches the predefined temperature, water can be liberated, preferably as vapour, which quickly penetrates the combustible and extinguishes the flame. On the other hand, the water-containing gel is essentially solid below the predefined temperature, and the water is kept confined in the gel matrix so that the normal functioning of the candle is not affected. The water-containing gel can also have a consistency that prevents it from falling out of the container if the latter is turned over or otherwise moved, for instance during transport or handling.

Preferably, the extinguishing substance comprises one of: natural agar, polymeric gel, starch-based gel, pectin, hydrosoluble methylcellulose, aqueous polyvinylpyrrolidone.

In another preferred embodiment, the extinguishing substance may be an emulsion of water in wax. This emulsion may be obtained by adding tensioactive substances to the wax, for example.

According to an alternative embodiment, the extinguishing material may comprise at least two components that combine at the predefined temperature and expand to extinguish the burning wax. In this way, the burning wax is effectively deprived of oxygen and thus quickly extinguished.

Preferably, the extinguishing material comprises an intumescent or foam-building substance, such as ammonium carbonate, ammonium bicarbonate, sodium bicarbonate, aluminium sulphate, ammonium phosphate, melamine-phosphate compounds, ammonium carbamate, etc.

It is particularly preferred that the predefined temperature is less than or equal to the flashpoint of the wax. Thus, the extinguishing action is initiated before the temperature of the combustible reaches the first critical point in temperature at which, for example, ignition of the vapours above the combustible will lead to combustion of the entire surface of the combustible.

According to another embodiment, the second portion is separated from the first portion by a partition or wall having a rupture temperature less than or equal to the predefined temperature. In this way, the partition or wall allows the extinguishing substance to expand as soon as it reaches the predefined temperature and to extinguish the burning combustible.

The term "rupture", as used herein, is intended to mean the creation of a communicating pathway between the second and first portion of the container allowing the passage of the extinguishing substance from the second portion to the first portion where the wax exceeding the predefined temperature is contained. Thus, the term "rupture" encompasses, but is not limited to, the physical breakage of the partition or wall, the melting of the partition or wall and, more generally, the creation of holes in the partition or wall.

Preferably, the partition or wall is in thermal contact with the extinguishing substance and the first portion. Thus, as soon as the temperature of the combustible in the first portion reaches the predefined critical temperature, the temperature of the partition or wall increases and causes also the extinguishing substance to reach the critical temperature, thus initiating the extinguishing action.

According to one embodiment, the partition or wall separates the second portion from the first portion along the bottom of the container. This allows a particularly easy manufacture of the container of the present invention.

Preferably, the partition or wall separates the second portion from the first portion along the whole inner surface of the container. Thus, even when the combustible reaches the predefined temperature only at an outer part of the container, e.g. close to the lateral container wall, for example due to the presence of a secondary wick there or due to a primary wick that has moved there (as sometimes happens with tea lights), the extinguishing action can set in at that part where the predefined temperature is exceeded.

Preferably, the partition or wall is impermeable. Thus, an desiccation of the extinguishing substance can be prevented.

In another embodiment the partition is a foil, lacquer or impregnant. This provides a particularly easy and cost effective way of manufacturing the partition and preventing the desiccation of the extinguishing substance.

Finally, according to another aspect of the invention, a candle is provided, comprising the container having some or all of the abovementioned features, with the first portion containing candle wax, lamp oil or petroleum gel, and a wick.

DETAILED DESCRIPTION OF A PREFERRED EMBODIMENT

In the following, several examples of a candle according to the present invention as well as their preparation will be described and compared with a candle of the state of the art. These candles have been subjected to tests in which the temperature of the wax has been brought above a predefined temperature.

Initially, several candles have been prepared according to the following method. As extinguishing substance, a water-based gel (described in further detail below) was heated and poured, optionally together with a densifier or water, into a candle container (diameter 6.5 cm, height 3.5 cm) that already contained a (primary) wick. Then, an additional (secondary) wick identical to the primary wick was introduced into the container in contact with the container wall, with its bottom end inserted into the extinguishing substance. This secondary wick served to bring the temperature of the wax above a critical temperature. The gel was then cooled to ambient temperatures and, subsequently, wax (paraffin) having a temperature between 60 and 70° C. was poured into the container.

In the candles of the examples, the following substances were chosen as materials for the water-based gel:

Agar 1000: food additive consisting of agar-agar "Agar 1000" (available from G.T.C. srl, Milan)

Agar 700: food additive consisting of agar-agar "Agar 700" (available from G.T.C. srl, Milan)

Acrylic: "Luquasorb 1010", superabsorbent gel on polymer basis (available from BASF)

Starch: starch for food use as available in supermarkets

Pectin: mixture of pectin, dextrose and citric acid for food use, available in supermarkets MC: "Methocel", hydrosoluble methylcellulose (available from Dow Chemical Company)

PVP: "Luvitec K 90", aqueous solution of 20 wt. % polyvinylpyrrolidone (available from BASF)

Ref 1 and 2: conventional candles based on paraffin, used for reference

Moreover, candles containing several concentrations of Agar 700 (in % of dry matter) have been prepared to examine the effect of the concentration of the extinguishing substance.

The candles thus prepared were ignited normally at their central (primary) wick. As soon as the paraffin had melted completely, the candle was insulated with glass wool along its perimeter and the secondary wick was ignited.

From this point on, the temperature of the wax was continuously determined by means of a thermometer and the point in time at which extinction of the candle occurred was measured. If a candle was extinguished, it was re-ignited and the measurement continued. The results are shown in the appended figures.

Figure 1:
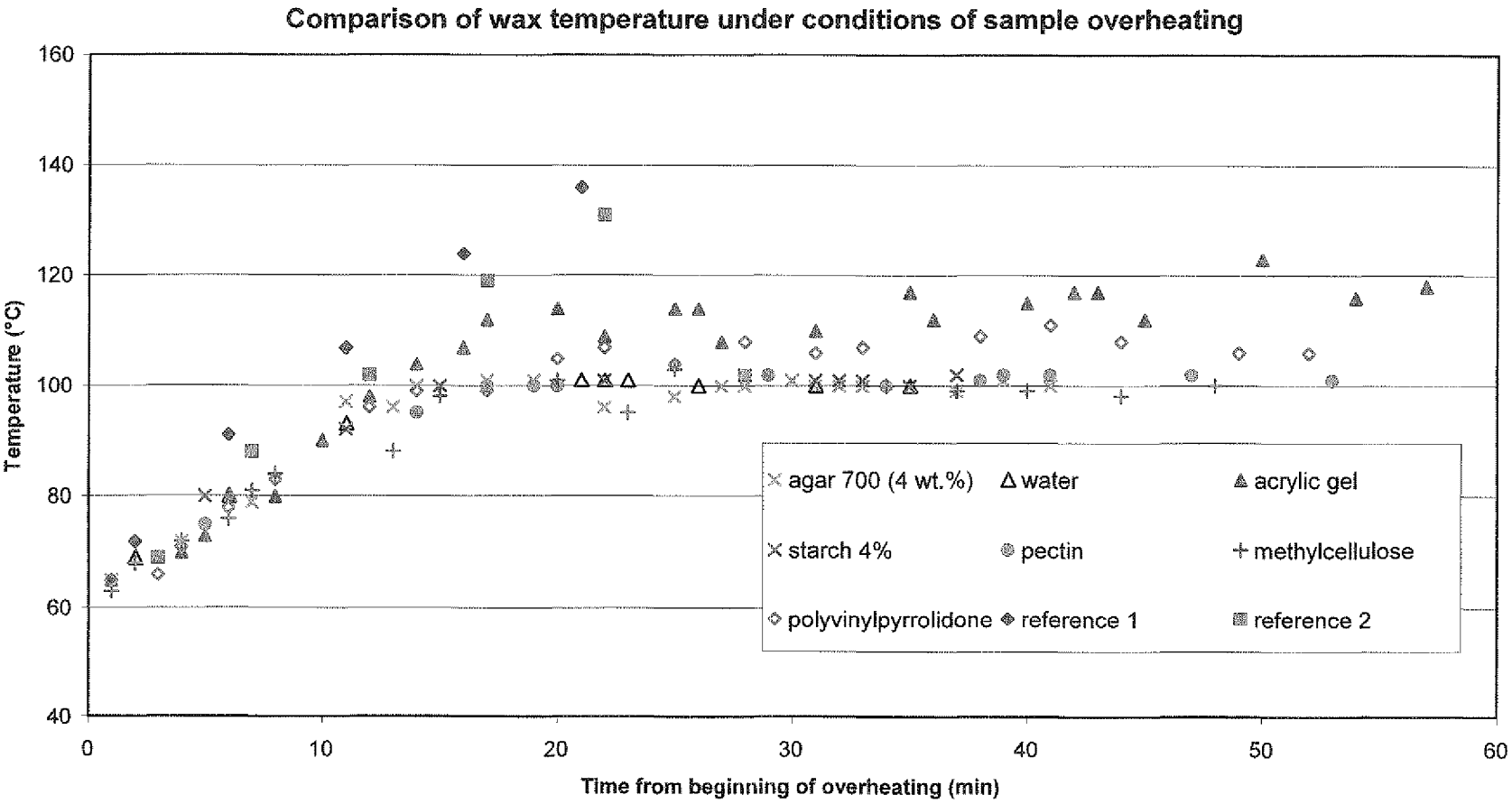
FIG. 1 is a graph showing the temperature—time relationships of several exemplary candles of the present invention containing different extinguishing substances.

As can be seen from FIG. 1, the conventional candles Ref 1 and Ref 2 steadily increase their temperature up to the flashpoint (above 140° C.), when they ignite. They had to be extinguished by hand to prevent damage to their surroundings.

The exemplary candles of the invention, however, showed generally a slower increase in temperature with time and reached a temperature plateau between 100 and 110° C. where their temperature remained until the fuel was exhausted (only the sample with acrylic gel reached 120° C. after about 50 minutes). Additionally, the inventive samples showed the extinguishing action at temperatures below or around 100° C., i.e. far from the flashpoint temperature of the wax.

Figure 2:
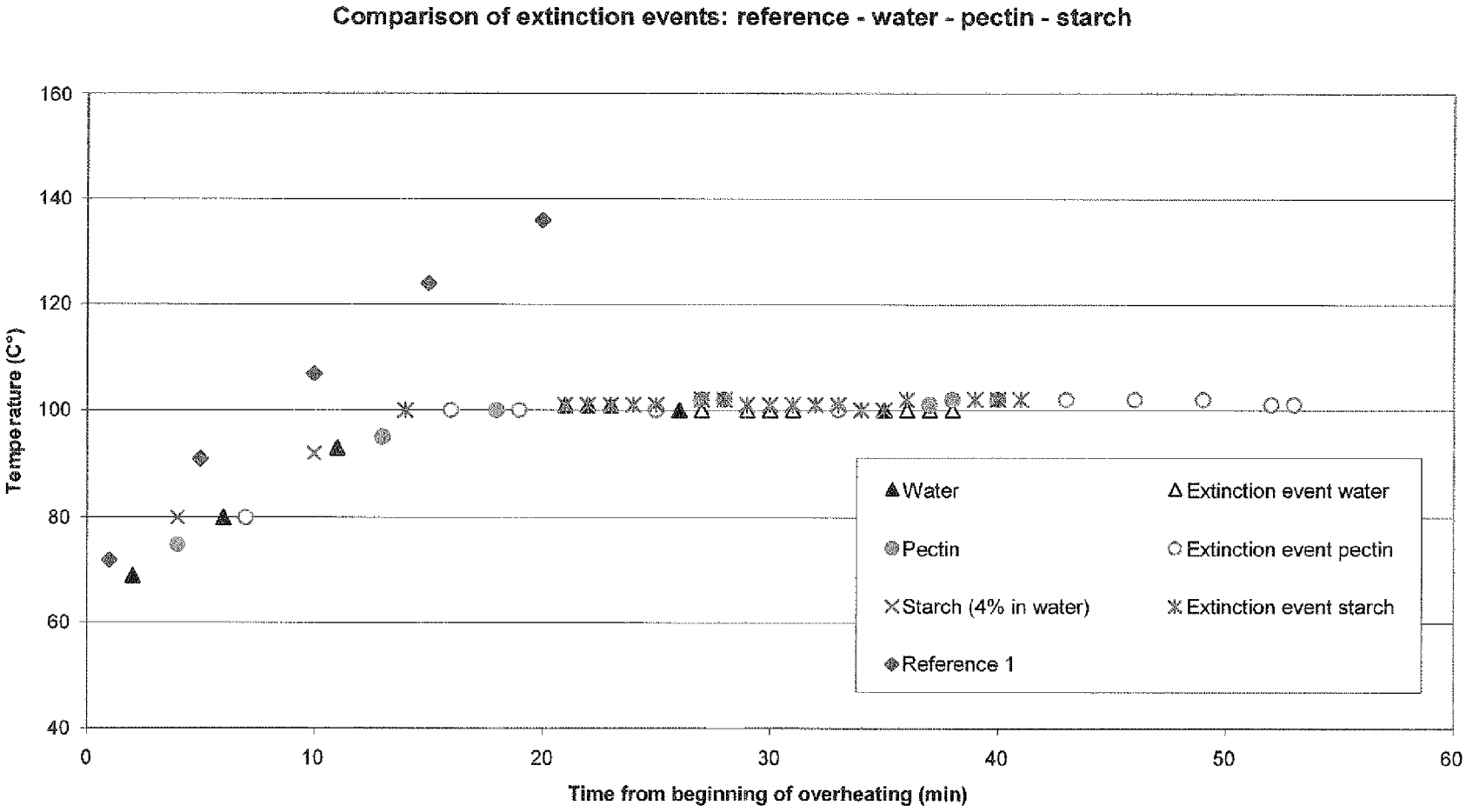
FIG. 2 is a graph comparing the flame extinction behaviour of those inventive candles containing water, pectin or starch.

As can be seen from FIG. 2, candles incorporating gels based on water, pectin or starch (4% dissolved in water) showed the lowest temperature plateaus with temperatures not significantly exceeding 100° C. While the pectin-based sample showed early extinction events after only 8 and 18 minutes, respectively, the starch based sample first extinguished at 14 minutes and 22 minutes but then extinguished continuously after approximately every 2 minutes. A similar behaviour was observed in the sample based on water only.

Figure 3:
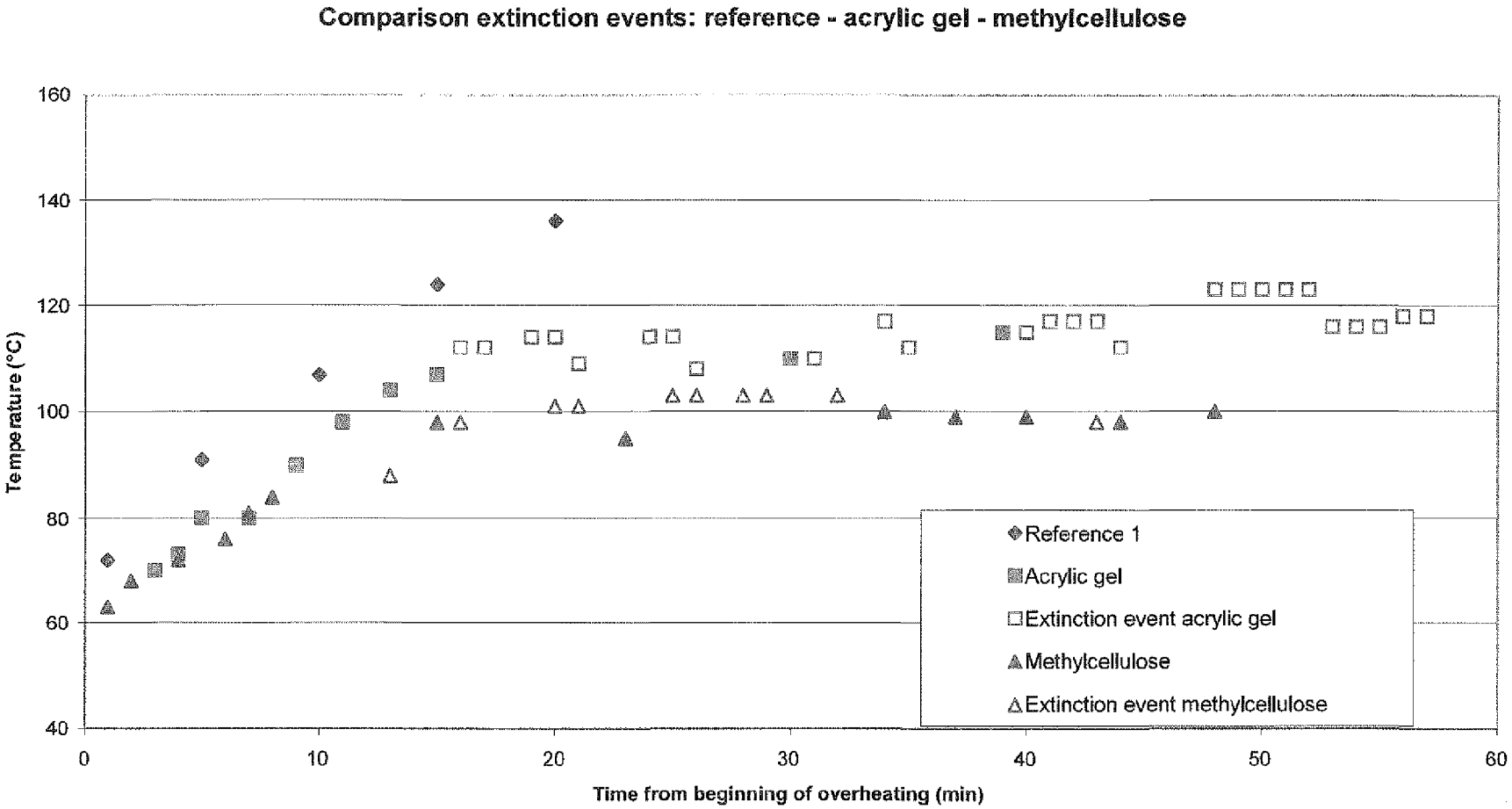
FIG. 3 is a graph comparing the flame extinction behaviour of those inventive candles containing acrylic gel or methylcellulose gel.

For the sample containing acrylic gel, shown in FIG. 3, the temperature plateau was somewhat higher than for the Samples of FIG. 2, lying at about 115° C. and touching 120° C. after about 50 minutes. Still, this sample showed very good extinction behaviour, with frequent extinctions occurring approximately every 2 minutes above 115° C.

The sample containing methylcellulose (see FIG. 3) showed a very good overall performance, maintaining steadily a wax temperature of around 100° C. (and after 30 minutes even below 100° C.) and extinguishing early (12 minutes) and frequently above 100° C.

Figure 4:
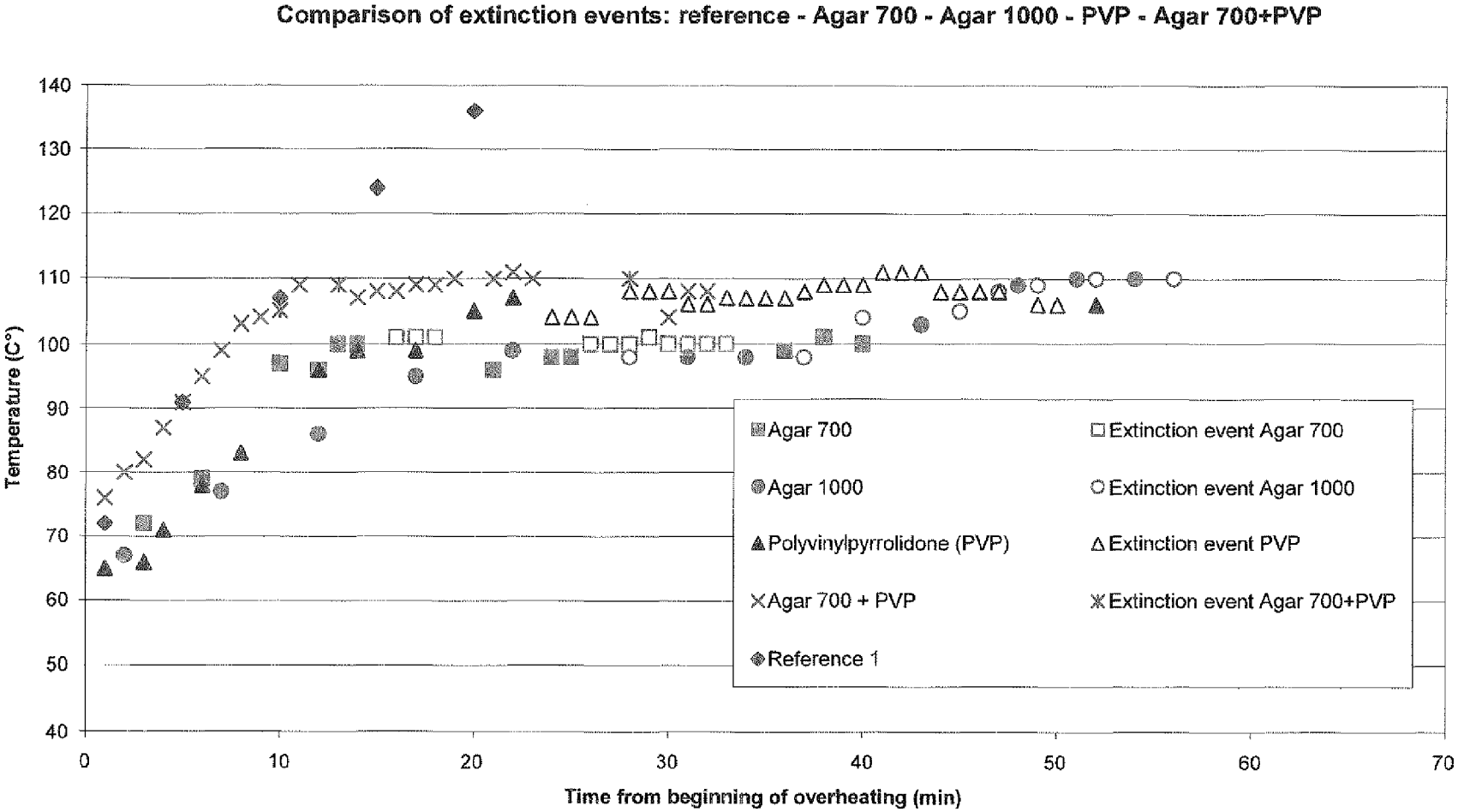
FIG. 4 is a graph comparing the flame extinction behaviour of those inventive candles containing different types of Agar or Agar mixtures.

In FIG. 4 the comparison was made for samples containing two different types of Agar as well as polyvinylpyrrolidone (PVP) and a mixture of Agar and PVP. The Agar samples showed similar behaviour, stabilizing around 100° C. and showing a frequent extinction activity. However, the Agar 700 sample showed an earlier onset of extinctions and a temperature plateau slightly below 100° C., while the Agar 1000 sample reached 110° C. after 50 minutes. Thus, the Agar 700 sample exhibited the best performance so far.

The PVP sample, on the other hand, stabilized at a higher temperature of 105 to 110° C. and exhibited, as expected, excellent extinction activity after reaching 105° C. (approximately after 23 minutes). In contrast, and surprisingly, the candle incorporating a gel mixture of Agar 700 and PVP rose quickly in temperature before stabilizing at 110° C. It exhibited only few extinction events at 12, 14 and 28 minutes.

Figure 5:
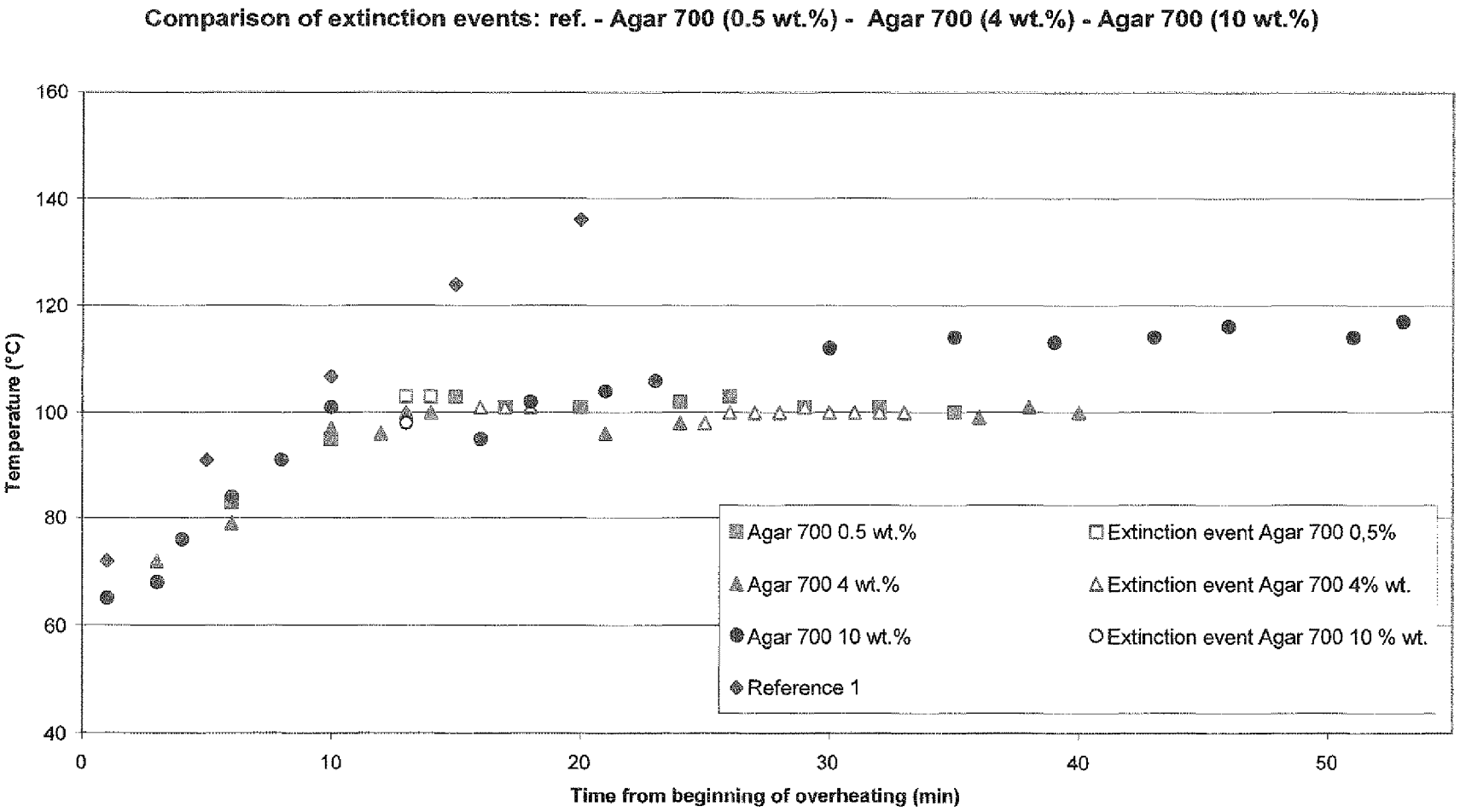
FIG. 5 is a graph comparing the flame extinction behaviour of exemplary candles containing different concentrations of Agar 700.

In order to study the effect of concentration of the extinguishing substance on the wax temperature and candle extinction performance, samples incorporating gels with differing amounts of Agar 700 were prepared as well. The results, shown in FIG. 5, indicate that an optimum concentration of Agar 700 of about 4% by weight exists which maintains the lowest temperature plateau and gives the most and most frequent extinction events. While the sample with 0.5 wt. % of Agar showed similar if slightly less favourable behaviour, the sample containing 10 wt. % of Agar 700 showed a higher temperature plateau of 110° C. and only one extinction event.

Analogous experiments were performed with different candle containers commonly know as tea lights (diameter 3.8 cm, height 1.7 cm) and night lights (diameter 3.8 cm, height 2.3 cm). Approximately 12.5 g and 20.7 g of wax were filled into the tea light and night light, respectively. The extinguishing substances tested were Agar 700, Agar 1000 and an acrylic gel. The sample preparation consisted of pouring the extinguishing substance into the containers and then inserting a pressed paraffin cylinder with a central wick hole on top of that. The measurements were performed in the same way as described for the 6.5 cm diameter containers above.

Again, the candles containing the extinguishing substance show a significantly slower temperature increase with time and reach a temperature plateau around 100° C. The night lights showed a very similar performance as the candles with the larger container discussed above. For tea lights, in the case of Agar 700, two extinctions, at 94 and 98° C. occurred in the interval of measurement, while the Agar 1000 sample extinguished three times at 98, 100 and 100° C. respectively. The sample containing acrylic gel extinguished once at 83° C.

Thus, at no time there was any danger that the candle wax temperature reached a critical point at which combustion of the whole wax might pose a danger to people and surrounding objects. Experimental evidence suggests that Agar 700 is the most efficient extinguishing substance for all examined types of candle. Still, also the other substances investigated significantly reduce the maximum temperatures reached by the candle wax and extinguish the flame efficiently.

The invention claimed is:

1. A candle comprising a container for holding a combustible, the combustible comprising candle wax, lamp oil or petroleum gel, the container having a first portion for receiving the combustible and a wick, and a second portion containing an extinguishing substance, wherein the extinguishing substance is in thermal contact with the first portion and is adapted to be set free into the first portion only when the combustible reaches a predefined temperature that is lower than or equal to the flashpoint, but higher than the melting point of the combustible, so as to reduce the maximum temperature reached by the combustible and extinguish the candle efficiently, and the second portion is separated from the first portion by a partition or wall having a rupture temperature less than or equal to the predefined temperature.

2. The candle of claim 1, wherein the extinguishing substance comprises a substance that is gaseous or releases gas above the predefined temperature.

3. The candle of claim 1, wherein the extinguishing substance is a water-containing gel.

4. The candle of claim 1, wherein the extinguishing substance comprises one of: natural agar, polymeric gel, starch-based gel, pectin, hydrosoluble methylcellulose, aqueous polyvinylpyrrolidone.

5. The candle of claim 1, wherein the extinguishing substance comprises an emulsion of water in wax.

6. The candle of claim 1, wherein the extinguishing material comprises at least two components that combine at the predefined temperature and expand to extinguish the burning wax.

7. The candle of claim 1, wherein the extinguishing material comprises an intumescent substance such as a PUR foams.

8. The candle of claim 1, wherein the partition or wall is in thermal contact with the extinguishing substance and the first portion.

9. The candle of claim 1, wherein the partition or wall separates the second portion from the first portion along the whole inner surface of the container.

10. The candle of claim 1, wherein the partition or wall separates the second portion from the first portion along the bottom of the container.

11. The candle of claim 1, wherein the partition or wall is impermeable.

12. The candle of claim 1, wherein the partition is a foil, lacquer or impregnant.

* * * * *